United States Patent [19]

Mermelstein et al.

[11] Patent Number: 4,844,824

[45] Date of Patent: Jul. 4, 1989

[54] STABLE HEAVY DUTY LIQUID DETERGENT COMPOSITIONS WHICH CONTAIN A SOFTENER AND ANTISTATIC AGENT

[75] Inventors: Robert Mermelstein, Cincinnati; Ronald L. Jacobsen, Wyoming, both of Ohio

[73] Assignee: The Procter & Gamble Company, Cincinnati, Ohio

[21] Appl. No.: 153,105

[22] Filed: Feb. 8, 1988

[51] Int. Cl.[4] ..... C11D 1/40; C11D 17/08

[52] U.S. Cl. ..... 252/8.75; 252/8.8; 252/120; 252/155; 252/545; 252/547; 252/DIG. 14

[58] Field of Search ..... 252/8.8, 525, 528, 545, 252/547, DIG. 14

[56] References Cited

U.S. PATENT DOCUMENTS

| | | | |
|---|---|---|---|
| 3,686,025 | 8/1972 | Morton | 117/140 R |
| 3,886,075 | 5/1975 | Bernardino | 252/8.75 |
| 3,936,537 | 2/1976 | Baskerville, Jr. et al. | 427/242 |
| 3,959,155 | 5/1976 | Montgomery | 252/8.8 |
| 3,985,668 | 10/1976 | Hartman | 252/99 |
| 4,024,078 | 5/1977 | Gilbert et al. | 252/551 |
| 4,062,647 | 12/1977 | Storm et al. | 8/137 |
| 4,095,946 | 6/1978 | Jones et al. | 8/137 |
| 4,108,600 | 8/1978 | Wong | 8/137 |
| 4,116,849 | 9/1978 | Leikhim | 252/103 |
| 4,126,674 | 11/1978 | Mausner | 424/31 |
| 4,272,386 | 6/1981 | Draper, Jr. et al. | 252/8.6 |
| 4,303,543 | 12/1981 | Mansy | 252/117 |
| 4,318,818 | 3/1982 | Letton et al. | 252/174.12 |
| 4,329,390 | 5/1982 | Danner | 428/264 |
| 4,375,416 | 3/1983 | Crisp | 252/8.7 |
| 4,490,285 | 12/1984 | Kebanli | 252/551 |
| 4,507,219 | 3/1985 | Hughes | 252/118 |
| 4,522,738 | 6/1985 | Magid et al. | 252/90 |
| 4,597,898 | 7/1986 | VanderMeer | 252/529 |
| 4,638,907 | 1/1987 | Bedenk | 206/0.5 |
| 4,698,167 | 10/1987 | Burckett St. Laurent et al. | 252/8.8 |
| 4,715,969 | 12/1987 | Rothanavibhata et al. | 252/8.7 |

FOREIGN PATENT DOCUMENTS

| | | |
|---|---|---|
| 0133804 | 6/1985 | European Pat. Off. . |
| 87202159 | 11/1987 | European Pat. Off. . |
| 1077103 | 7/1967 | United Kingdom . |
| 1077104 | 7/1967 | United Kingdom . |
| 1230792 | 5/1971 | United Kingdom . |
| 2185992 | 8/1987 | United Kingdom . |
| 8722844 | 9/1987 | United Kingdom . |

OTHER PUBLICATIONS

Pending U.S. patent application Ser. Nos. 153,172, 153,173, Caswell, filed 2/8/88.

*Primary Examiner*—Paul Lieberman
*Assistant Examiner*—Kathleen Markowski
*Attorney, Agent, or Firm*—Donald E. Hasse; Richard C. Witte; Thomas H. O'Flaherty

[57] ABSTRACT

Heavy duty liquid laundry detergent compositions which clean, soften and provide static control, and which comprise: (1) sulfated (optionally ethoxylated) alcohol anionic surfactant, (2) ion pair complex, (3) cumene, xylene, or toluene sulfonate, (4) smectite-type clay, and (5) ethoxylated nonionic surfactant. The compositions are in the form of stable, homogeneous suspensions which have a low viscosity, a near-neutral pH, and a specified yield value. Such compositions impart fabric care benefits through-the-wash without significantly impairing cleaning performance.

18 Claims, No Drawings

STABLE HEAVY DUTY LIQUID DETERGENT COMPOSITIONS WHICH CONTAIN A SOFTENER AND ANTISTATIC AGENT

TECHNICAL FIELD

The present invention relates to concentrated heavy duty liquid laundry detergent compositions which simultaneously provide cleaning, softening and static control benefits. The compositions contain sulfated (optionally ethoxylated) alcohol anionic surfactant, ion pair complex, cumene, xylene or toluene sulfonate, smectite-type clay, and an ethoxylated nonionic surfactant. The compositions are in the form of stable, homogeneous suspensions which have a relatively low viscosity. The compositions impart fabric care benefits through-the-wash without significantly impairing cleaning performance.

BACKGROUND OF THE INVENTION

There are several patents in which sulfated ethoxylated alcohol anionic detergents are discussed.

U.S. Pat. No. 4,715,969, Rothanavibhata et al., issued Dec. 29, 1987, discloses a fabric softening heavy duty liquid detergent composition of a density in the range of 1.15 to 1.35 g/ml at room temperature, a pH in the range of 9.5 to 11, and a viscosity in the range of 1,000 to 5,000 centipoises, which does not increase to more than 5,000 centipoises on thirty days quiescent storage at room temperature, which comprises sodium linear alkylbenzene sulfonate, sodium alkylpolyethoxy sulfate, sodium tripolyphosphate, sodium carbonate, bentonite, sodium polyacrylate, and water.

U.S. Pat. No. 4,318,818, Letton et al., issued Mar. 9, 1982, discloses heavy duty liquid detergents containing enzymes and an enzyme-stabilizing system comprising calcium ion and a low molecular weight carboxylic acid or salt, preferably a formate. The compositions can contain various surfactants, including the anionic and nonionic surfactants herein. Examples 1 and 13 disclose compositions containing $C_{12-13}$ alkylpolyethoxylate(6.5) and $C_{12-14}$ alkylpolyethoxy(3) sulfate.

U.S. Pat. No. 4,024,078, Gilbert et al., issued May 17, 1977, discloses liquid dishwashing detergents containing ethoxylated decyl alcohol sulfates having a high monoethoxylate content. Ethoxylated alcohol nonionic surfactants can be included in the compositions as optional ingredients, but are not exemplified.

U.S. Pat. No. 4,490,285, Kebanli, issued Dec. 25, 1984, discloses heavy duty liquid detergent compositions containing ethoxylated alcohol nonionic surfactant, a solvent system comprising water or mixtures thereof with a certain alcohol or polyol, and a sulfated approximately monoethoxylated fatty alcohol.

U.S. Pat. No. 4,507,219, Hughes, issued Mar. 26, 1985, discloses heavy duty liquid detergents containing sulfonate and alcohol ethoxylate sulfate anionic surfactants, ethoxylated nonionic surfactant, optional quaternary ammonium, amine or amine oxide surfactants, saturated fatty acid, polycarboxylate builder, a neutralization system comprising sodium, potassium and preferably low levels of alkanolamines, and a solvent system comprising ethanol, polyol and water.

There are a number of patents which describe the use of smectite-type clays in detergent compositions as textile softeners. See U.S. Pat. No. 4,062,647, Storm et al., issued Dec. 13, 1977, in which the detergent compositions, although they clean well, require large contents of clay for effective softening. The use of clay together with a water-insoluble cationic compound in an electrically conductive metal salt as a softening composition adapted for use with anionic, nonionic, zwitterionic and amphoteric surfactants has been described in British Pat. No. 1,483,627, published Aug. 24, 1977.

U.S. Pat. No. 3,936,537, Baskerville, Jr., et al., issued Feb. 3, 1976, contains a review of optional clay additives in detergent compositions.

British Patent Application No. 87-22844, Raemdonck et al., published Nov. 4, 1987, discloses granular and liquid detergent compositions containing a smectite-type clay fabric softener and a polymeric clay flocculating agent, from which the clay particles are more effectively deposited onto the fabrics during laundering.

U.S. Pat. No. 3,985,668, Hartman, issued Oct. 12, 1976, discloses clays as suspending agents for use in stable, false body hard surface cleaners.

Clay is used as a thickening and corrosion protection agent for preferred usage in highly alkaline thickened aqueous liquid hypohalite compositions in U.S. Pat. No. 4,116,849, Leikhim, issued Sept. 26, 1978.

British Patent Applications Nos. 1,077,103 and 1,077,104, published July 26, 1967, disclose amine-anionic surfactant ion pair complexes useful as antistatic agents. These complexes are applied directly to the fabric from an aqueous carrier. There is no suggestion in either of these references that such complexes could be added to detergent compositions to impart fabric care benefits through-the-wash. In fact, such complexes are delivered in solubilized form and therefore could not be delivered through-the-wash.

Fatty acid-amine ion pair complexes in granular detergents are disclosed in European Patent Application No. 133,804, Burckett-St. Laurent et al., published June 3, 1985.

More recently, in European Patent Application No. 87202159.7, filed Nov. 6, 1987, amine-anionic compound ion pair complex particles having an average particle diameter of from about 10 microns to about 300 microns are disclosed. These particles provide excellent through-the-wash softening without significantly impairing cleaning performance. Furthermore, European Patent Application No. 87202159.7 discloses that ion pair particles which are made from lower chain length alkyl amines impart improved processing characteristics and improved chemical stability in liquid detergents.

It is an object of the present invention to provide heavy duty liquid detergent compositions which provide excellent fabric conditioning benefits as well as excellent cleaning performance.

It is also an object of this invention to provide heavy duty liquid detergent compositions which are homogeneous suspensions and stable at room temperature.

It is yet another object of this invention to provide heavy duty liquid detergent compositions which have a relatively stable viscosity less than 600 centipoises.

It is still another object of this invention to provide heavy duty liquid detergent compositions which maintain good static control performance over time.

SUMMARY OF THE INVENTION

The present invention relates to a stable heavy duty liquid detergent composition comprising, by weight:

(a) from about 2% to about 15% of an anionic surfactant which is a sulfated alcohol having a straight or branched alkyl chain containing from about 10 to about 20 carbon atoms with an average of from 0 to about 4 moles of ethylene oxide per mole of alcohol;

(b) from about 0.5% to about 20% of water-insoluble particles ranging in diameter from about 10 to about 500 microns, said particles comprising, by weight: (1) from about 5% to about 100% of an ion pair complex having the formula:

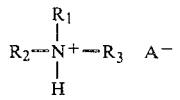

wherein $R_1$ and $R_2$ independently are $C_{12}$ to $C_{20}$ alkyl or alkenyl, $R_3$ is H or $CH_3$, and A is an organic anion selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, and olefin sulfonates; and mixtures thereof; and (2) from about 95% to 0% of an ion pair complex having the formula:

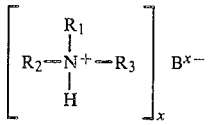

wherein $R_1$ and $R_2$ can independently be $C_{12}$ to $C_{20}$ alkyl or alkenyl, $R_3$ is H, $CH_3$, or a $C_2$–$C_{20}$ alkyl or alkenyl, B is an inorganic anion selected from the group consisting of sulfate, hydrogen sulfate, nitrate, phosphate, hydrogen phosphate, and dihydrogen phosphate, and x is an integer between 1 and 3, inclusive; and mixtures thereof;

(c) from about 0.5% to about 5% of cumene, xylene or toluene sulfonate, or mixtures thereof;

(d) from about 0.5% to about 2.5% of smectite-type clay selected from the group consisting of sodium hectorite, potassium hectorite, lithium hectorite, magnesium hectorite, calcium hectorite, sodium montmorillonite, potassium montmorillonite, magnesium montmorillonite, calcium montmorillonite, sodium saponite, potassium saponite, lithium saponite, magnesium saponite, calcium saponite, and mixtures thereof; and (e) from about 5% to about 20% of a nonionic surfactant produced by condensing an average of from about 3 to about 20 moles of ethylene oxide with 1 mole of an alcohol having a straight or branched alkyl chain containing from about 8 to about 16 carbon atoms, said nonionic surfactant having a Hydrophilic-Lipophilic Balance of from about 8 to about 15;

said composition having a viscosity in the range of from about 50 to about 600 centipoises, a pH in the range of from about 6.5 to about 9.5, and a yield value in the range of from about 10 to about 150 dynes per square centimeter.

DESCRIPTION OF THE INVENTION

The instant compositions contain five essential ingredients which are: (1) an anionic surfactant which is a $C_{10-20}$ alkyl sulfate containing an average of from 0 to about 4 moles of ethylene oxide per mole of alcohol, (2) ion pair complex, (3) cumene, xylene or toluene sulfonate, (4) smectite-type clay, and (5) a nonionic surfactant which is an ethoxylated alcohol. These ingredients are described as follows:

ANIONIC SURFACTANT

The anionic surfactant herein is a narrowly defined product prepared by optionally ethoxylating an alcohol, either straight or branched chain, having an alkyl group containing from about 10 to about 20 carbon atoms, preferably from about 12 to about 16 carbon atoms, with an average of up to about 4, preferably up to about 2.5, moles of ethylene oxide per mole of alcohol, by a conventional alkaline-catalyzed ethoxylation reaction; sulfating the resulting product; and then neutralizing with an appropriate base. The products obtained have a substantial amount of alkyl sulfate and may contain a mixture of ethoxylate chain lengths. The anionic surfactant is used as a water soluble or dispersible salt, preferably a sodium, potassium, ammonium, monoethanol ammonium, diethanol ammonium, triethanol ammonium, or magnesium salt, or mixtures thereof, most preferably a sodium salt.

The detergent compositions herein contain from about 2% to about 15%, by weight, preferably from about 3% to about 10%, of this anionic surfactant.

This ingredient provides cleaning performance and extends the effectiveness of the second ingredient, the ion pair complex, over time.

ION PAIR COMPLEX

The second essential ingredient of the instant composition is the ion pair complex, which acts as a textile softener and antistatic agent. The ion pair complex is added to the compositions as water insoluble particles ranging in diameter from about 10 to about 500 microns. The particles represent, by weight, from about 0.5% to about 20%, preferably from about 3% to about 10%, of the instant detergent compositions.

The ion pair complex particles comprise:

(1) from about 5% to about 100% by weight of said particles, of an ion pair complex having the formula:

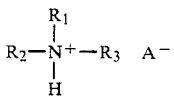

(1)

wherein $R_1$ and $R_2$ independently are $C_{12}$ to $C_{20}$ alkyl or alkenyl, $R_3$ is H or $CH_3$, and A is an organic anion selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, and olefin sulfonates; and mixtures thereof; and (2) from about 95% to 0% of an ion pair complex having the formula:

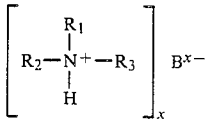

(2)

wherein $R_1$ and $R_2$ independently are $C_{12}$ to $C_{20}$ alkyl or alkenyl, $R_3$ is H, $CH_3$, or a $C_2$–$C_{20}$ alkyl or alkenyl, B is an inorganic anion selected from the group consisting of sulfate, hydrogen sulfate, nitrate, phosphate, hydrogen phosphate, and dihydrogen phosphate, and x is an integer between 1 and 3, inclusive; and mixtures thereof.

It has been found that in order for said particles to impart their fabric care benefits through the wash they must have an particle diameter ranging from about 10 to about 500 microns. Preferably the particles have an average diameter of less than about 250 microns, more preferably less than about 200 microns, and most preferably less than about 150 microns. Also preferably, the particles have an average diameter of greater than about 20 microns, more preferably greater than about 40 microns, and most preferably greater than about 50 microns.

"Average particle diameter" represents the mean particle size diameter of the actual particles of a given material. The mean is calculated on a weight percent basis. The mean is determined by conventional analytical techniques such as, for example, laser light diffraction or microscopic determination utilizing a scanning electron microscope. Preferably, greater than 50% by weight, more preferably greater than 60% by weight, and most preferably greater than 70% by weight, of the particles have actual diameters which are less than about 250 microns, preferably less than about 200 microns, and most preferably less than about 150 microns. Also preferably, greater than 50% by weight, more preferably greater than 60% by weight, and most preferably greater than 70% by weight, of the particles have actual diameters which are greater than about 20 microns, preferably greater than 40 microns, and most preferably greater than about 50 microns.

The ion pair particles of the present invention contain from about 5% to about 100%, by weight of the particles, of the amine-organic anion ion pair complex of Formula (1) and from about 95% to 0% of the amine-inorganic anion ion pair complex of Formula (2), preferably between about 40% and about 90% of the Formula (1) complex and between about 60% and about 10% of the Formula (2) complex, more preferably between about 50% to about 80% of the Formula (1) ion pair and about 50% to about 20% of the Formula (2) ion pair, most preferably about 70% of the Formula (1) ion pair and about 30% of the Formula (2) ion pair.

The ratio of Formula (1) to Formula (2) ion pair complex can affect whether particles containing these ion pair complexes have a gelatinous (soft) or crystalline (hard) character at a particular temperature. By including proportionately more of the ion pair complex of Formula (2) in comelt mixtures, the particles tend to become more crystalline (hard), and therefore easier to form into particles by prilling or mechanical processing. By including proportionately more of the fabric care active ion pair complex of Formula 1 in comelt mixtures, particles made from such comelt mixtures tend to have higher fabric care conditioning performance.

Starting alkylamines for both the Formula (1) and Formula (2) ion pair complexes are of the formula:

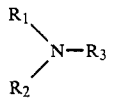

wherein each $R_1$ and $R_2$ are independently $C_{12}$ to $C_{20}$ alkyl or alkenyl, preferably $C_{16}$ to $C_{18}$ alkyl or alkenyl, and most preferably $C_{16}$ to $C_{18}$ alkyl, and $R_3$ is H, $CH_3$, or $C_2$–$C_{20}$ alkyl or alkenyl. Suitable non-limiting examples of starting amines include hydrogenated ditallow amine, hydrogenated ditallow methyl amine, unhydrogenated ditallow amine, unhydrogenated ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, and stearyl arachidyl methyl amine. Most preferred are hydrogenated ditallow and distearyl amine, hydrogenated tritallow amine, hydrogenated ditallow methyl amine, unhydrogenated tritallow amine, unhydrogenated ditallow methyl amine, tripalmityl amine, dipalmityl methyl amine, tristearyl amine, distearyl methyl amine, triarachidyl amine, diarachidyl methyl amine. Preferred are hydrogenated ditallow and distearyl amine and hydrogenated tritallow and tristearyl amine.

The organic anions (A) useful in the ion pair complex of the present invention are the alkyl sulfonates, aryl sulfonates, alkylaryl sulfonates, alkyl sulfates, alkyl ethoxylated sulfates, dialkyl sulfosuccinates, ethoxylated alkyl sulfonates, alkyl oxybenzene sulfonates, acyl isethionates, acylalkyl taurates, and paraffin sulfonates.

Preferred organic anions are the $C_1$–$C_{20}$ alkyl sulfonates, $C_1$–$C_{20}$ alkylaryl sulfonates, $C_1$–$C_{20}$ alkyl sulfates, $C_1$–$C_{20}$ alkyl ethoxylated sulfates, aryl sulfonates, and dialkyl sulfosuccinates.

More preferred are the $C_1$–$C_{20}$ alkyl ethoxylated sulfates, $C_1$–$C_{20}$ alkylaryl sulfonates, aryl sulfonates, and dialkyl sulfosuccinates.

Even more preferred are $C_1$–$C_{20}$ alkylaryl sulfonates and aryl sulfonates and especially preferred are benzene sulfonates (as used herein, benzene sulfonates contain no hydrocarbon chain attached directly to the benzene ring) and $C_1$–$C_{13}$ alkylaryl sulfonates, including the linear $C_1$–$C_{13}$ alkyl benzene sulfonates (LAS). The benzene sulfonate moiety of LAS can be positioned at any carbon atom of the alkyl chain.

Most preferred organic anions are benzene sulfonates and $C_1$14 $C_8$ linear alkylbenzene sulfonates (LAS), particularly $C_1$–$C_3$ LAS.

The organic anions listed above can generally be obtained in their salt forms from commercial chemical sources such as Aldrich Chemical Co., Inc. in Milwaukee, Wis., Vista Chemical Co. in Ponca, Okl., and Reutgers-Nease Chemical Co. in State College, Penn. Typically these organic anions are obtained as sodium or potassium salts, but other soluble salts may also be utilized. The amines can be obtained from Sherex Chemical Corp. in Dublin, Ohio.

Non-limiting examples of alkylamine-organic anion ion pair complexes of Formula (1) suitable for use in the present invention include:

ditallow amine (hydrogenated or unhydrogenated) complexed with a linear $C_1$–$C_{20}$ alkyl benzene sulfonate (LAS), ditallow methyl amine (hydrogenated or unhydrogenated) complexed with a $C_1$–$C_{20}$ LAS, dipalmityl amine complexed with a $C_1$–$C_{20}$ LAS, dipalmityl methyl amine complexed with a $C_1$–$C_{20}$ LAS, distearyl amine complexed with a $C_1$–$C_{20}$ LAS, distearyl methyl amine complexed with a $C_1$–$C_{20}$ LAS, diarachidyl amine complexed with a $C_1$–$C_{20}$ LAS, diarachidyl methyl amine complexed with a $C_1$–$C_{20}$ LAS, palmityl stearyl amine complexed with a $C_1$–$C_{20}$ LAS, palmityl stearyl methyl amine complexed with a $C_1$–$C_{20}$ LAS,
palmityl arachidyl amine complexed with a $C_1$–$C_{20}$ LAS,
palmityl arachidyl methyl amine complexed with a $C_1$–$C_{20}$ LAS,
stearyl arachidyl amine complexed with a $C_1$–$C_{20}$ LAS,
stearyl arachidyl methyl amine complexed with a $C_1$–$C_{20}$ LAS,
ditallow amine (hydrogenated or unhydrogenated) complexed with an aryl sulfonate,
ditallow methyl amine (hydrogenated or unhydrogenated) complexed with an aryl sulfonate,
dipalmityl amine complexed with an aryl sulfonate,
dipalmityl methyl amine complexed with an aryl sulfonate,
distearyl amine complexed with an aryl sulfonate,
distearyl methyl amine complexed with an aryl sulfonate,
diarachidyl amine complexed with an aryl sulfonate,
diarachidyl methyl amine complexed with an aryl sulfonate,
palmityl stearyl amine complexed with an aryl sulfonate,
palmityl stearyl methyl amine complexed with an aryl sulfonate,
palmityl arachidyl amine complexed with an aryl sulfonate, and
palmityl arachidyl methyl amine complexed with an aryl sulfonate,
stearyl arachidyl amine complexed with an aryl sulfonate, and
stearyl arachidyl methyl amine complexed with an aryl sulfonate, and mixtures of these ion pair complexes.

More preferred are complexes formed from the combination of ditallow amine (hydrogenated or unhydrogenated) complexed with an aryl sulfonate or $C_1$–$C_{20}$ alkylaryl sulfonate, ditallow methyl amine (hydrogenated or unhydrogenated) complexed with an aryl sulfonate or with a $C_1$–$C_{20}$ alkylaryl sulfonate, and distearyl amine complexed with an aryl sulfonate or with a $C_1$–$C_{20}$ alkylaryl sulfonate. Even more preferred are those complexes formed from hydrogenated ditallow amine or distearyl amine complexed with a benzene sulfonate or a $C_1$–$C_{13}$ linear alkylbenzene sulfonate (LAS). Even more preferred are complexes formed from hydrogenated ditallow amine or distearyl amine complexed with a benzene sulfonate or a $C_1$–$C_8$ linear alkylbenzene sulfonate. Most preferred are complexes formed from hydrogenated ditallow amine or distearyl amine complexed with $C_1$–$C_3$ LAS, particularly $C_3$ LAS.

The inorganic anion component of the amine-inorganic anion ion pair complex can be obtained from inorganic acids including acids having monovalent, divalent, and trivalent anions such as, but not limited to, sulfuric acid, nitric acid, and phosphorous acid. Especially preferred is sulfuric acid. These acids are commonly available from chemical supply companies, including Aldrich Chemical Company, Inc., Milwaukee, Wisc., and Sigma Chemical Company, St. Louis, Mo.

The said particles contain the amine-organic anion ion pair complex of Formula (1) and optionally the amine-inorganic anion ion pair complex of Formula (2). These two types are physically combined in a way such that particles can be formed which comprise both. This can be accomplished by separately forming each type, and then mixing the two molten ion pair complexes together. Another method for providing a mixture of the two types of ion pair complexes is to form said complexes conjointly, for example by preparing a melt containing the organic anion component, A, the inorganic component, B, and a sufficient amount of the amine components to form the desired levels of each type of ion pair complex.

The complexing of the amine with the organic anion and with the inorganic anion results in ion pair entities which are chemically distinct from the respective starting materials. Such factors as the type of amine and the type of organic anion or inorganic anion employed, the ration of the amine to the organic anion and inorganic anion, in addition to the ratio of amine-organic anion ion pair complex to amine-inorganic anion ion pair complex can affect the physical properties of the resulting complexes. These properties include the thermal phase transition point, which affects whether the complex has a gelatinous (soft) or solidified (hard) character at a particular temperature.

The amine and organic anion are combined in a molar ratio of amine to anionic compound ranging from about 10:1 to about 1:2, preferably from about 5:1 to about 1:2, more preferably from about 2:1 to 1:2 and most preferably about 1:1. For the preferred amine-organic anion/amine-inorganic anion fabric conditioning agent wherein the organic anion is $C_1$–$C_3$ LAS and the inorganic anion is the divalent sulfate anion, the amine and inorganic anion are combined in a molar ratio ranging from about 10:1 to about 1:2, preferably, from about 5:1 to about 1:2, more preferably from about 3:1 to about 1:1, and most preferably about 2:1. The amine quantity indicated in the above ratios is based upon separate preparation of the Formula (1) and Formula (2) ion pair complexes. Accordingly, when the Formula (1) and Formula (2) ion pair complexes are formed conjointly, the molar ration of amine to organic anion to inorganic anion will depend on the preferred ration of Formula (1) and Formula (2) complexes. This will depend on the identities of the complexes and the desired application. For example, for the most preferred ditallow amine $C_3$ LAS/ditallow amine sulfate complex in a 70/30 weight ratio, the molar ratio will be 5.7:3.7:1.

The ion pair complexes can be formed by a variety of methods, including but not limited to, preparing a melt of A, the organic anion (in acid form), and/or B, the inorganic anion (in acid form), with the amine, and then processing to the desired particle size range.

Another method of forming the ion pair complex includes heating the amine to a liquid state and then adding this molten amine component to separated, heated, acidified, aqueous solutions of the organic anion and the inorganic anion, mixing the two solutions, and then extracting the ion pair complex by using a solvent, such as chloroform. Alternatively, the molten amine can be added to a mixture of heated, acidified, aqueous solutions of the organic anion and inorganic anion, followed by solvent extraction.

The desired particle sizes can be achieved by, for example, mechanically grinding the mixture of ion pair complexes in blenders (e.g., an Oster® blender) or in large scale mills (e.g., a Wiley® Mill) to the desired particle size range. Preferably, the particles are formed by prilling in a conventional manner, such as by hydraulically forcing a comelt of a mixture of the ion pair complexes through a heated nozzle, and atomizing into an environment with a temperature below the melting point of the comelt. Prior to passage through the nozzle, the comelt should be in a well-mixed condition, for example by continuously circulating the comelt through a loop at sufficient velocity to prevent settling. As an alternative to hydraulically forcing the comelt through the nozzle, air injection can be used to pass the comelt through the nozzle. The particles that result from prilling are preferably spherical and particle diameters within the applicable and preferred ranges of this invention can be obtained. Comelts of complexes which are gelatinous (ie, soft) at room temperature can be mechanically ground to achieve the desired particle size after flash freezing by using, for example, liquid nitrogen. The particles can then be incorporated into a liquid delivery system, such as a detergent base or an aqueous base useful for forming an aqueous dispersion of the particles. Alternately for liquid applications, the comelt can be added to the liquid delivery system, such as a detergent base, and then be formed into particles by high shear mixing.

The complexes can be characterized for the purposes of this invention by their thermal phase transition points. As used hereafter, the thermal phase transition (hereinafter alternately referred to as "transition point") shall mean the temperature at which the complex exhibits softening (solid to liquid crystal phase transition) or melting (solid to isotropic phase transition) whichever occurs first upon heating. The transition point temperatures can be determined by differential scanning colorimetry (DSC) and polarized light microscopy. The first transition point of solid particles made from the comelt mixtures of the present invention will preferably be between about 10° C. and about 100° C., more preferably between about 30° C. and about 100° C., and most preferably between about 40° C. and about 80° C.

With respect to the amine-organic anion ion pair complexes, generally shorter chain length anionic compounds will form complexes with higher transition points than complexes that are identical except for having an anionic compound with a longer chain length. Highly preferred ion pairs are made with $C_1$–$C_{13}$ LAS and benzene sulfonate and generally have transition points in the range of 15° C. -100° C. The amine-organic anion ion pair complexes made with $C_6$–$C_{13}$ LAS generally have first transition points in the range of about 15° C. to about 30° C. and tend to be gelationus (soft). The amine-organic anion ion pair complexes made with $C_1$–$C_5$ LAS and benzene sulfonate (i.e., no alkyl chain) generally have first transition points in the range of about 30° C. to about 100° C. and tend to be more solidified (hard), and therefore tend to form comelted amine-organic anion/amine-in-organic anion ion pair complex mixtures that are more susceptible to prilling, and also have better chemical stability in liquid detergent compositions for a given level of amine-inorganic anion ion pair complex.

Preferred particles are made with organic anion components derived from benzene sulfonates and $C_1$–$C_3$ LAS and have transition points, by themselves, in the range of about 40° C. to about 100° C.

Preferred amine-organic anion ion pair complexes include those comprised of a hydrogenated ditallow amine or distearyl amine complexed with a $C_1$ to $C_8$ LAS or benzene sulfonate in a 1:1 molar ratio. These complexes have transition points generally between about 20° C. and about 100° C. These preferred ion pair complexes are preferably formed into particles also containing hydrogenated ditallow amine or distearyl amine complexed with sulfates.

It has been found that when $R_3$ of the amine component of the amine-inorganic anion ion pair complex is H or $CH_3$, the thermal properties of the material are changed, resulting in a harder ion pair complex particle at room temperature. The particle is therefore more susceptible to reproducible and controlled production (including production by prilling) and handing. This is beneficial for both granular and liquid product formulations.

Especially large increases in chemical stability of the particles in detergent compositions can be attained when $R_3$ of the amine of the amine-inorganic anion ion pair complex is a $C_{12}$–$C_{20}$ alkyl or alkenyl.

The temperature ranges listed above are approximate in nature, and are not meant to exclude complexes outside of the listed ranges. Further, the particular amine of the ion pair complex can affect the transition point.

The ideal particle made from an ion pair complex is sufficiently large so as to become entrapped in fabrics during washing, and has a transition point which is low enough that at least a substantial part of the particle, preferably the entire particle, will soften or melt at conventional automatic laundry dryer temperatures, but not so low that it will melt during the fabric wash or rinse stages.

The ion pair complex ingredient can be incorporated into the detergent compositions of the present invention with little, if any, detrimental effect on cleaning. The ion pair complex provides conditioning benefits across a variety of laundry conditions, including machine or hand washing followed by machine drying and also machine or hand washing followed by line drying.

CUMENE, XYLENE OR TOLUENE SULFONATE

The third essential ingredient of the instant composition is selected from the group consisting of water-soluble salts of cumene, xylene and toluene sulfonate, and mixtures thereof, and comprises from about 0.5% to about 5%, preferably from about 1% to about 2%, by weight of the heavy duty liquid detergent compositions. Salts of cumene sulfonate, especially the sodium salt, are preferred.

This class of ingredients demonstrates the surprising benefit of lowering the viscosity of the total composition to a desired range, despite the presence of the second (ion pair complex particles) and fourth (smectite-type clay) essential ingredients, which otherwise would raise the viscosity of the instant compositions out of the desirable range. Thus, the cumene, xylene or toluene sulfonate is acting as a viscosity reducing agent rather than a hydrotrope. The viscosity range desired for this application is from about 50 to about 600 centipoises. The method of measuring viscosity is defined hereinafter.

Relative to traditional viscosity reducing agents (such as ethanol), cumene, xylene and toluene sulfonate are substantially more effective at lowering viscosity in the present compositions, with salts of cumene sulfonate appearing to be most effective.

SMECTITE-TYPE CLAY

The fourth essential ingredient of the heavy duty liquid detergent composition described herein is smectite-type clay, which is selected from the group consisting of sodium hectorite, potassium hectorite, lithium hectorite, magnesium hectorite, calcium hectorite, sodium montmorillonite, potassium montmorillonite, magnesium montmorillonite, calcium montmorillonite, sodium saponite, potassium saponite, lithium saponite, magnesium saponite, calcium saponite, and mixtures thereof. All of these may be organically modified. The hectorites may be natural or synthetic.

Preferred smectite-type clays are organically modified sodium montmorillonite and potassium montmorillonite.

Examples are the Bentone TM line form NL Chemicals, Inc., Hightstown, NJ. One example is M-P-A TM 14 (formerly called Bentone TM 14), manufactured by NL Chemicals, Inc., which is described as an antisettling additive for solvent-besed organic systems. (See NL product description No. DS 154, 8/82).

These smectite-type clays may be added to the composition at levels from about 0.5% to about 2.5% by weight, preferably about 0.7% to about 1.5% by weight. The clays used herein have a particle size range of up to about 1 micron in product.

The clay minerals which are not organically modified can be described as expandable, three-layer clays, i.e., aluminosilicates and magnesium silicates, having an ion exchange capacity of at least 50 meq/100 g. of clay and preferably at least 60 meq/100 g. of clay. The starting clays for the organically modified clays can be similarly described. The term "expandable" as used to describe clays relates to the ability of the layered clay structure to be swollen, or expanded, on contact with water. The three-layer expandable clays used herein are those materials classified geologically as smectites.

There are tow distinct classes of smectite-type clays that can be broadly differentiated on the basis of the numbers of octahedral metal-oxygen arrangements in the central layer for a given number of silicon-oxygen atoms in the outer layers.

The clays employed in these compositions contain cationic counterions such as protons, sodium ions, potassium ions, calcium ions, and lithium ions, It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation: smectite clay $(Na)^+ + NH_4OH =$ smectite clay $(NH_4)^+ + NaOH$. Since in the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay (meq/100 g). The cation exchange capacity of clays can be measured in several ways, including by electrodialysis, by exchange with ammonium ion followed by titration, or by a methylene blue procedure, all as fully set forth in Grimshaw, "The Chemistry and Physics of Clays", pp. 264–265, Interscience (1971).

The cation exchange capacity of a clay mineral relates to such factors as the expandable properties of the clay, the charge of the clay (which in turn is determined at least in part by the lattice structure), and the like. The ion exchange capacity of clays varies widely in the range from about 2 meq/100 g. of kaolinites to about 150 meq/100 g., and greater, for certain smectite clays.

Without meaning to be bound by theory. it is believed that the smectie-type clay functions in the present compositions as a lattice-like structure which uniformly suspends the ion pair complex particles. Without the clay, the ion pair complex particles aggregate on the top of the liquid detergent base. With the clay, a heavy duty liquid detergent that is a stable, homogeneous suspension having a desirable yield value of from about 10 to about 150 dynes per square centimeter is obtained.

NONIONIC SURFACTANT

The fifth essential ingredient of the instant compositions is from about 5% to about 20%, preferably from about 7% to about 14%, by weight, of a nonionic detergent surfactant derived by condensing an average of from about 3 to about 20, preferably from about 5 to about 10, moles of ethylene oxide with 1 mole of an alcohol, preferably a primary alcohol, having a straight or branched alkyl chain containing from about 8 to about 16, preferably from about 10 to about 14, carbon atoms. It is important that the nonionic surfactant have an HLB (Hydrophilic-Lipophilic Balance) of from about 8 to about 15, preferably from about 9 to about 12. The HLB of the ethoxylated nonionics herein can be experimentally determined in a known fashion or can be calculated in the manner set forth in Dekker "Emulsions, Theory and Practice", Reinhold 1965, pages 233 and 248. The HLB of the nonionic surfactants can be approximated by the simple expression $HLB = E/5$, wherein E is the weight percentage of ethylene oxide content in the molecule. The HLB will vary for a given alkyl chain length with the amount of ethylene oxide in the molecule.

Mixtures of the foregoing nonionic surfactants are also useful herein and are readily available from commercial alcohol mixtures. The degree of ethoxylation can also vary somewhat inasmuch as materials prepared by commercial processes are generally mixtures having a broad ethoxylate distribution. A particularly preferred nonionic surfactant is the condensation product of a mixture of $C_{12-13}$ fatty alcohol with an approximate average of 6.5 moles of ethylene oxide per mole of alcohol.

The nonionic surfactant, in conjunction with the anionic surfactant herein, provides enhanced detergency, is compatible chemically with the ion pair, and contributes to the uniformity and phase stability of the base detergent system. When the nonionic surfactant is present at levels below about 5% by weight, the base detergent matrix separates into two liquid phases.

OPTIONAL INGREDIENTS

In addition to the essential ingredients, the compositions herein preferably contain other ingredients known for use in detergent compositions. Optional ingredients include othe surfactants, builders, neutralizing agents, buffering agents, phase regulants, hydrotropes, enzymes, enzyme stabilizing agents, soil refesse agents, polyacids, suds regulants, opacifiers, antioxidants, bactericides, dyes, perfumes, and brighteners, all of which are described in U.S. Pat. No. 4,285,841, Barrat et al, issued Aug. 25, 1981, incorporated herein by reference.

Enzymes are highly preferred optional ingredients and are incorporated in an amount of from about 0.025% to about 2%, preferably from about 0.05% to about 1.5%. Preferred proteolytic enzymes should provide a proteolytic activity of at least about 5 Anson units (about 1,000,000 Delft units) per liter, preferably from about 15 to about 70 Anson units per liter. most preferably from about 20 to about 40 Anson units per liter. A proteolytic activity of from about 0.01 to about 0.05 Anson units per gram of product is desirable. Other enzymes, including amylolytic enzymes, are also desirably included in the present compositions.

The enzymes herein are preferably characterized by an isoelectric point of from about 8.5 to about 10, more preferably from about 9 to about 9.5.

Suitable proteolytic enzymes include the many species known to be adapted for use in detergent compositions. Commercial enzyme preparations such as "Alcalase" sold by Novo Industries, and "Maxatase" sold by Gist-Brocades, Delft, The Netherlands, are suitable. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

Suitable amylases include "Rapidase" sold by Gist-Brocades and "Termamyl" sold by Novo Industries.

A more complete disclosure of suitable enzymes can be found in U.S. Pat. No. 4,101,457, Place et al, issued July 18, 1978, incorporated herein by reference.

When enzymes are incorporated in the detergent compositions of this invention, they are desirably stabilized by using a mixture of a short chain carboxylic acid salt and calcium ion.

The short chain carboxylic acid salt is preferably water-soluble, and most preferably is a formate, e.g., sodium formate. The short chain carboxylic acid salt is used at a level from about 0.25% to about 10%, preferably from about 0.3% to about 3%, more preferably from about 0.5% to about 1.5%. At the higher product pHs (8.5–9.5). only formates are suitable.

Any water-soluble calcium salt can be used as a source of calcium ion, including calcium acetate, calcium formate and calcium chloride. The composition should contain from about 0.1 to about 30 millimoles of calcium ion per liter, preferably from about 0.5 to about 15 millimoles of calcium ion per liter. When materials are present which complex calcium ion, it is necessary to use high levels of calcium ion so that there is always some minimum level available for the enzyme. Preferably, the compositions are substantially free of materials such as detergent builders that tie up calcium ion to permit sufficient enzyme-available calcium to be present. However, excellent enzyme stability is achieved with very low levels of calcium ion when the formates are used, especially at a low pH (less than about 8.5).

The compositions of the present invention also may contain from about 40% to about 90%, preferably from about 55% to about 80%, by weight of a solvent system comprising water, or mixtures thereof with an alcohol containing from 1 to 6 carbon atoms or a polyol containing from 2 to 6 carbon atoms and from 2 to 6 hydroxy groups. The compositions can contain from 0% to about 15%, preferably less than about 10%, more preferably less than about 5%, of the alcohol or polyol.

Examples of suitable alcohols are methanol, ethanol (preferred), propanol, isopropanol, and n-hexanol. Examples of such polyols include propylene glycol, ethylene glycol and glycerine.

The compositions herein may also contain up to about 15%, preferably up to about 10%, by weight of the composition of a detergent builder selected from the group consisting of water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates.

PHYSICAL PROPERTIES

The compositions of the present invention have a viscosity of from about 50 to about 600 centipoises (cps), preferably from about 250 to about 450 cps, at 70° F. (21.1° C.), when measured as described hereinafter. This relatively low viscosity is desired for convenient pouring from a container by the user. The viscosity preferably remains stable over time, for example, at least about 6 months, preferably at least about 12 months, when stored at a temperature of about 25° C.

The compositions of the present invention have a yield value of from about 10 to about 150 dynes per square centimeter, preferably from about 30 to about 80, when measured at 70° F. (21.1° C.) as defined hereinfafter. A method used to abtain yield value is described in "A Method for the Interpretation of Brookfield Viscosities" by R.L. Bowles, R.P. Davie, and W.D. Todd in *Modern Plastics*, November, 1955, pg. 140 to 146.

The compositions of the present invention also generally have a specific gravity of from about 0.99 to about 1.06, preferably from about 1.00 to about 1.02, when measured with a Mettler/Paar Densitometer at 70° F. (21.1° C.).

The pH of the compositions herein is from about 6.5 to about 9.5, preferably from about 7.0 to about 8.5. The compositions are homogeneous suspensions that are preferably physically and chemically stable throughout storage and use.

As used herein, yield value is determined as follows using an RVT Brookfield Viscometer with an RVT No. 3 spindle.

1. Fill a 8 fl. oz. (0.238 L.) glass jar, having an inside diameter of about 5.0 cm, to the base of the neck with the product to be tested. Cap the jar and allow the sample to equilibrate for about 1 hour at 70° F. (21.1° C.).
2. Set the viscometer speed at 0.5 rpm.
3. Place the spindle in the sample to the depth indicated by the groove in the shaft. If the sample is extremely viscous, it may be necessary to move the jar back and forth until the sample fills in around the spindle.
4. Turn on the viscometer. The spindle will begin rotating. After 6 minutes record the dial reading.
5. Turn off the viscometer, but leave the spindle in the sample.
6. Set the viscometer speed at 1.0 rpm.
7. Turn on the viscometer. After 3 minutes record the dial reading.
8. The Yield Value, in dynes/cm$^2$, is calculated as follows: Yield Value=[(reading @0.5 rpm) ×2− (reading @1 rpm)]×10.

As used herein, viscosity is determined as follows using an RVT Brookfield Viscometer with an RVT No. 3 spindle.

1. Fill a 8 fl. oz. (0.238 L.) glass jar, having an inside diameter of about 5 cm, to the base of the neck with the product to be tested. Cap the jar and allow the sample to equilibrate for 1 hour to 70° F. (21.1° C.).
2. Place the spindle in the sample to the depth indicated by the groove in the shaft.
3. Set the viscometer speed to 50 rpm.
4. Turn on the instrument and the spindle will begin rotating. After 1 minute record the dial reading. Viscosity is calculated as follows: viscosity (cps.)=dial reading×20.

The following examples illustrate the compositions of the present invention.

All parts, percentages and ratios used herein are by weight unless otherwise specified. Levels of ethoxylation indicated are averages.

EXAMPLE I

A heavy duty liquid laundry detergent composition of the present invention is as follows.

| Component | Active Weight % |
|---|---|
| Sodium $C_{12-14}$ alkylethoxy(1) sulfate | 4.70 |
| $C_{12-13}$ alcohol polyethoxylate (6.5) | 10.75 |
| Sodium cumene sulfonate | 1.33 |
| Prills | 7.10 |
| Hydrogenated ditallow amine (HDTA) cumene sulfonate (1:1 molar in all Examples) (5.0%) | 70% |
| $(HDTA)_2$ sulfate (2:1 molar in all Examples) (2.1%) | 30% |
| Clay (organically modified sodium montmorillonite) | 1.50 |
| Ethanol | 3.10 |
| Sodium formate | 1.60 |
| Calcium formate | 0.10 |
| Sodium diethylenetriamine pentaacetate (DTPA) | 0.20 |
| Anti-redeposition agent | 1.50 |
| Protease enzyme | 0.88 |
| Amylase enzyme | 0.15 |
| Blue dye | 0.004 |
| Perfume | 0.50 |
| Water | 66.50 |

The process used to make this composition is as follows.

| Stock Material | Weight Percent |
|---|---|
| Step 1. | |
| Water | 27.52 |
| Ethanol (92%) | 1.35 |
| Brightener | 0.11 |
| $Na_5$ DTPA | 0.09 |
| Alkylethoxy sulfate paste mixture | 9.99 |
| Sodium $C_{12-14}$ alkylethoxy(1) sulfate | 47.03 |
| Ethanol | 18.60 |
| $Na_5$ DTPA | 1.06 |
| Water | 33.31 |
| Sodium formate (30%) | 5.33 |
| $C_{12-13}$ alcohol polyethoxylate (6.5) | 10.75 |
| Anti-redeposition agent (80%) | 1.88 |
| Calcium formate (10%) | 1.00 |
| Sodium cumene sulfonate (45%) | 2.96 |
| Step 2. | |
| Clay slurry in water (5% organically modified montmorillonite clay) | 30.00 |
| Step 3. | |
| Protease enzyme | 0.88 |
| Amylase enzyme | 0.15 |
| Blue Dye | 0.40 |
| Perfume | 0.50 |
| Step 4. | |
| Prills (10–500 microns diameter; 170 microns, average) | 7.10 |
| (HDTA) cumene sulfonate | 70.00 |
| $(HDTA)_2$ sulfate | 30.00 |

The ingredients listed in step 1 are added to a mixing tank with a single agitator in the order which they appear above. Before the calcium formate is added, the pH of the mix is lowered to below 9.0 by adding 0.04 parts of citric acid. The clay slurry listed in step 2 is made by mixing the clay into water with an agitator and further dispersing the solids by recycling through a centrifugal pump. After the clay slurry (step 2) has stood for approximately one day, it is added to the mix tank containing the ingredients from step 1. After 1 to 2 days, the pH of the formulation intermediate (steps 1 and 2) is lowerd to 7.7 by adding less than 0.04 parts of citric acid. This formulation intermediate is then processed through a Gaulin Homogenizer (APV Gaulin Inc., Everett, Mass., Model No. 100 M3-8TBS) at a pressure of 6000 pounds per square inch gauge (psig), a shear rate of 150,000 $sec^{-1}$, and for 1 pass. This processing step is important to activate the clay as an effective suspension agent. Product-making continues by adding the ingredients listed in step 3, in the order in which they appear above, to the formulation intermediate which was processed through the homogenizer. This is done with constant agitation. Finally, the prills described in step 4 (made by hydraulically forcing a comelt of the mixture of the ion pair complexes through a heated nozzle, and atomizing into an environment with a temperature below the melting point of the comelt) are added by hand crutching into the liquid with very little mechanical agitation (less than 100 rpm).

This formulation is a stable, homogeneous heavy duty liquid which cleans, softens and controls static well and at 70° F. (21.1° C.) has a viscosity of about 350 cps, a pH of 7.6, and a yield value of about 39 dynes/$cm^2$.

EXAMPLE II

A heavy duty liquid laundry detergent composition of the present invention is as follows.

| Component | Active Weight % |
|---|---|
| Sodium $C_{12-14}$ alkylethoxy(1) sulfate | 2.35 |
| $C_{12-13}$ alcohol polyethoxylate (6.5) | 10.75 |
| Sodium cumene sulfonate | 0.50 |
| Prills | 7.10 |
| (HDTA) cumene sulfonate (5.0%) | 70% |
| $(HDTA)_2$ sulfate (2.1%) | 30% |
| Clay (organically modified sodium montnorillonite) | 1.50 |
| Ethanol | 3.10 |
| Sodium formate | 1.60 |
| Calcium formate | 0.10 |
| Sodium diethylenetriamine pentaacetate (DTPA) | 0.25 |
| Anti-redeposition agent | 1.50 |
| Brightener | 0.11 |
| Water | 71.14 |

The process used to make this composition is as follows.

| Stock Material | Weight Percent |
|---|---|
| Step 1. | |
| Water | 23.16 |
| Brightener | 0.11 |
| $Na_5$ DTPA | 0.20 |
| Sodium formate (30%) | 5.33 |
| $C_{12-13}$ alcohol polyethoxylate (6.5) | 10.75 |
| Anti-redeposition agent (80%) | 1.88 |
| Calcium formate (10%) | 1.00 |
| Step 2. | |
| Clay slurry in water (5% organically modified montmorillonite clay) | 30.00 |
| Step 3. | |
| Ethanol (92%) | 2.35 |
| Alkylethoxy sulfate paste mixture | 5.00 |
| Sodium $C_{12-14}$ alkylethoxy(1) sulfate | 47.03 |
| Ethanol | 18.60 |
| $Na_5$ DTPA | 1.06 |
| Water | 33.31 |
| Sodium cumene sulfonate (45%) | 1.11 |

-continued

| Stock Material | Weight Percent |
|---|---|
| Water | 12.00 |
| Step 4. | |
| Prills (10–500 microns diameter; 165 microns, average) | 7.10 |
| (HDTA) cumene sulfonate (5.0%) | 70.00 |
| $(HDTA)_2$ sulfate (2.1%) | 30.00 |

The ingredients listed in step 1 are added to a mixing tank with a single agitator in the order which they appear above. Before the calcium formate is added, the pH of the mix is lowered to below 9.0 by adding 0.04 parts of citric acid. The clay slurry listed in step 2 is made by mixing the clay into water with an agitator. This clay slurry (step 2) is immediately added to the ingredients from step 1. This formulation intermediate is then processed through a Gaulin Homogenizer as in Example I. Product making continues by adding the ingredients listed in step 3, in the order in which they appear above, to the formulation intermediate which was processed through the homogenizer. The ingredients are hand mixed at this point. Finally, the prills described om st 4 are added and mixed in by hand, followed by mechanical agitation for less than a minute.

The resulting stable, homogeneous heavy duty liquid suspension has at 70° F. (21.1° C.) a viscosity of about 320 cps, a pH of 8.7, and a yield value of about 75 dynes/cm$^2$.

EXAMPLE III

A heavy duty liquid laundry detergent composition of the present invention is as follows.

| Component | Active Weight % |
|---|---|
| Sodium $C_{12-14}$ alkylethoxy(1) sulfate | 8.50 |
| $C_{12-13}$ alcohol polyethoxylate (6.5) | 9.72 |
| Sodium cumene sulfonate | 4.52 |
| Prills | 6.42 |
| (HDTA) cumene sulfonate (5.0%) | 70% |
| $(HDTA)_2$ sulfate (2.1%) | 30% |
| Clay (organically modified sodium montmorillonite) | 1.36 |
| Ethanol | 3.36 |
| Sodium formate | 1.45 |
| Calcium formate | 0.09 |
| Sodium diethylenetriamine pentaacetate (DTPA) | 0.37 |
| Anti-redeposition agent | 1.36 |
| Brightener | 0.10 |
| Water | 62.75 |

The process used to make this composition is identical to that described for Example II, except that the ingredients/amounts in steps 1, 2, 3, and 4 are as follows.

| Stock Material | Weight Percent |
|---|---|
| Step 1. | |
| Water | 20.94 |
| Brightener | 0.10 |
| $Na_5$ DTPA | 0.18 |
| Sodium formate (30%) | 4.82 |
| $C_{12-13}$ alcohol polyethoxylate (6.5) | 9.72 |
| Anti-redeposition agent (80%) | 1.70 |
| Calcium formate (10%) | 0.90 |
| Step 2. | |
| Clay slurry in water (5% organically modified montmorillonite clay) | 27.12 |

-continued

| Stock Material | Weight Percent |
|---|---|
| Step 3. | |
| Alkylethoxy sulfate paste mixture | 18.07 |
| Sodium $C_{12-14}$ alkylethoxy(1) sulfate | 47.03 |
| Ethanol | 18.60 |
| $Na_5$ DTPA | 1.06 |
| Water | 33.31 |
| Sodium cumene sulfonate (45%) | 10.04 |
| Step 4. | |
| Prills (10–500 microns diameter) | 6.42 |
| (HDTA) cumene sulfonate | 70.00 |
| $(HDTA)_2$ sulfate | 30.00 |

The resulting stable, homogeneous heavy duty liquid suspension at 70° F. (21.1° C.) has a viscosity of about 480 cps, a pH of 9.1, and a yield value of about 146 dynes/cm$^2$.

EXAMPLE IV

A heavy duty liquid laundry detergent composition of the present invention is as follows.

| Component | Active Weight % |
|---|---|
| Sodium $C_{12-14}$ alkylethoxy(1) sulfate | 2.35 |
| $C_{12-13}$ alcohol polyethoxylate (6.5) | 10.75 |
| Sodium cumene sulfonate | 1.33 |
| Prills | 15.00 |
| (HDTA) cumene sulfonate (5.0%) | 70% |
| $(HDTA)_2$sulfate (2.1%) | 30% |
| Clay (organically modified sodium montmorillonite) | 1.50 |
| Ethanol | 3.10 |
| Sodium formate | 1.60 |
| Calcium formate | 0.10 |
| Sodium diethylenetriamine pentaacetate (DTPA) | 0.25 |
| Anti-redeposition agent | 1.50 |
| Brightener | 0.11 |
| Water | 62.41 |

The process used to make this composition is identical to that described for Example II, except that the amounts in steps 1–4 are as follows.

| Stock Material | Weight Percent |
|---|---|
| Step 1. | |
| Water | 23.16 |
| Brightener | 0.11 |
| $Na_5$ DTPA | 0.20 |
| Sodium formate (30%) | 5.33 |
| $C_{12-13}$ alcohol polyethoxylate (6.5) | 10.75 |
| Anti-redeposition agent (80%) | 1.88 |
| Calcium formate (10%) | 1.00 |
| Step 2. | |
| Clay slurry in water (5% organically modified montmorillonite clay) | 30.00 |
| Step 3. | |
| Ethanol (92%) | 2.35 |
| Alkylethoxy sulfate paste mixture | 5.00 |
| Sodium $C_{12-14}$ alkylethoxy(1) sulfate | 47.03 |
| Ethanol | 18.60 |
| $Na_5$ DTPA | 1.06 |
| Water | 33.31 |
| Sodium cumene sulfonate (45%) | 2.96 |
| Water | 2.30 |
| Step 4. | |
| Prills (10–500 microns diameter; 165 microns, average) | 15.00 |
| (HDTA) cumene sulfonate | 70.00 |
| $(HDTA)_2$ sulfate | 30.00 |

This stable, hmogeneous heavy duty liquid suspension at 70° F. (21.1° C.) has a viscosity of about 540 cps, a pH of 8.4, and a yield value of about 133 dynes/cm$^2$.

EXAMPLE V

A heavy duty liquid laundry detergent composition of the present invention is as follows.

| Component | Active Weight % |
|---|---|
| Sodium $C_{12-14}$ alkylethoxy(1) sulfate | 4.58 |
| $C_{12-13}$ alcohol polyethoxylate (6.5) | 5.00 |
| Sodium cumene sulfonate | 1.30 |
| Prills | 3.00 |
| (HDTA) cumene sulfonate (5.0%) | 70% |
| $(HDTA)_2$ sulfate (2.1%) | 30% |
| Clay (organically modified sodium montmorillonite) | 2.00 |
| Ethanol | 3.03 |
| Sodium formate | 1.56 |
| Calcium formate | 0.10 |
| Sodium diethylenetriamine pentaacetate (DTPA) | 0.19 |
| Anti-redeposition agent | 1.46 |
| Brightener | 0.11 |
| Water | 77.67 |

The process used to make this composition is identical to that described for Example II, except that the ingredients/amounts in steps 1–4 are as follows.

| Stock Material | Weight Percent |
|---|---|
| Step 1. | |
| Water | 18.25 |
| Ethanol (92%) | 1.32 |
| Brightener | 0.11 |
| $Na_5$ DTPA | 0.09 |
| Alkylethoxy sulfate paste mixture | 9.75 |
| Sodium $C_{12-14}$ alkylethoxy(1) sulfate | 47.03 |
| Ethanol | 18.60 |
| $Na_5$ DTPA | 1.06 |
| Water | 33.31 |
| Sodium formate (30%) | 5.20 |
| Anti-redeposition agent (80%) | 1.83 |
| Calcium formate (10%) | 0.98 |
| Sodium cumene sulfonate (45%) | 2.89 |
| Step 2. | |
| Clay slurry in water (6.67% organically modified sodium montmorillonite clay) | 29.98 |
| Step 3. | |
| $C_{12-13}$ alcohol polyethoxylate (6.5) | 5.00 |
| Water | 21.60 |
| Step 4. | |
| Prills (10–500 microns diameter) | 3.00 |
| (HDTA) cumene sulfonate | 70.00 |
| $(HDTA)_2$ sulfate | 30.00 |

This stable, homogeneous heavy duty liquid suspension at 70° F. (21.1° C.) has a viscosity of about 240 cps, a pH of 8.0, and a yield value of about 107 dynes/cm$^2$.

Other compositions of the present invention are obtained when the sodium $C_{12-14}$ alkylethoxy(1) sulfate in the above examples is replaced with the corresponding alkyl sulfate, alkylethoxy (2.25) sulfate, and alkylethoxy (4) sulfate.

Other compositions herein are also obtained when the prills in the above compositions are replaced with corresponding (HDTA) cumene sulfonate prills, (HDTA) $C_8$ linear alkylbenzene sulfonate prills, and (HDTA) $C_8$ linear alkylbenzene sulfonate/$(HDTA)_2$ sulfate prills, or if ditallow amine (DTA) is replaced with distearyl amine (DSA).

Other compositions are obtained when the sodium cumene sulfonate is replaced with sodium xylene and toluene sulfonate.

Other compositions are also obtained when the $C_{12-13}$ alcohol polyethoxylate (6.5) is replaced with $C_{9-11}$ alcohol polyethoxylate (5), and $C_{12-15}$ alcohol polyethoxylate (7), and when the clay is replaced with a sodium hectorite or saponite clay.

What is claimed is:

1. A stable heavy duty liquid detergent composition comprising, by weight of the total composition:

(a) from about 2% to about 15% of an anionic surfactant which is a sulfated alcohol having a straight or branched alkyl chain containing from about 10 to about 20 carbon atoms with an average of from 0 to about 4 moles of ethylene oxide per mole of alcohol;

(b) from about 0.5% to about 20% of water-insoluble particles ranging in diameter from about 10 to about 500 microns, said particles comprising, by weight: (1) from about 5% to about 95%, total particle weight basis, of an ion pair complex having the formula:

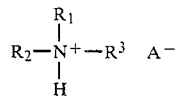

wherein $R_1$ and $R_2$ independently are $C_{12}$ to $C_{20}$ alkyl or alkenyl, $R_3$ is H or $CH_3$, and A is an organic anion selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, and olefin sulfonates; and mixtures thereof; and (2) from about 95% to 5% total particle weight basis of an ion pair complex having the formula:

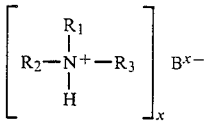

wherein $R_1$ and $R_2$ ≠*independently are* C12 to $C_{20}$ alkyl or alkenyl, $R_3$ is H, $CH_3$, or a $C_2$–$C_{20}$ alkyl or alkenyl, B is an inorganic anion selected from the group consisting of sulfate, hydrogen sulfate, nitrate, phosphate, hydrogen phosphate, and dihydrogen phosphate, and x is an integer between 1 and 3, inclusive; and mixtures thereof;

(c) from about 0.5% to about 5% of a water-soluble salt of a cumene, xylene or toluene sulfonate, or mixtures thereof;

(d) from about 0.5% to about 2.5% of smectite-type clay selected from the group consisting of sodium hectorite, potassium hectorite, lithium hectorite, magnesium hectorite, calcium hectorite, sodium montmorillonite, potassium montmorillonite, magnesium montmorillonite, calcium montmorillonite, sodium saponite, potassium saponite, lithium saponite, magnesium saponite, calcium saponite, and mixtures thereof; and (e) from about 5% to about 20% of a nonionic surfactant produced by condensing an average of from about 3 to about 20 moles of ethylene oxide with 1 mole of an alcohol having a straight or branched alkyl chain containing from about 8 to about 16 carbon atoms, said nonionic surfactant having a Hydrophilic-Lipophilic Balance of from about 8 to about 15;

said composition at about 70° F. (21.1° C.) having a viscosity in the range of from about 50 to about 600 centipoises, a pH in the range of from about 6.5 to about 9.5, and a yield value in the range of from about 10 to 150 dynes per square centimeter.

2. A composition according to claim 1 comprising from about 7% to about 14% of a nonionic surfactant produced by condensing an average of from about 5 to about 10 moles of ethylene oxide with 1 mole of a primary alcohol having a straight alkyl chain containing from about 10 to about 14 carbon atoms, said nonionic surfactant having an HLB of from about 12.

3. A composition according to claim 1 comprising from about 3% to about 10% or $C_{12-16}$ alkyl sulfate containing an average of from 0 to about 2.5 moles of ethylene oxide per mole of alkyl sulfate.

4. A composition according to claim 3 wherein the alkyl sulfate contains an average of about 1 mole of ethylene oxide per mole of alkyl sulfate.

5. A composition according to claim 1 comprising from about 3% to about 10% of ion pair complex particles having an average diameter of from about 20 to about 250 microns, said particles comprising: (1) from about 40% to about 90% by weight of said particles, of an ion pair complex having the formula:

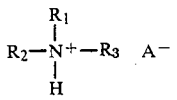

wherein $R_1$, $R_2$, $R_3$ and A are as stated in claim 1; and (2) from about 60% to about 10%, by weight of said particles, of an ion pair complex having the formula:

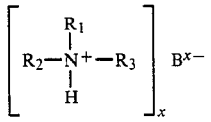

wherein $R_1$, $R_2$, $R_3$, B and x are as stated in claim 1.

6. A composition according to claim 5 wherein the ion pair complex particles comprise about 50% to about 80% of an ion pair complex of hydrogenated ditallow or distearyl amine and cumene sulfonate and from about 50% to about 20% of an ion pair complex of hydrogenated ditallow or distearyl amine and sulfate.

7. A composition according to claim 5 comprising from about 1% to about 2% of a water-soluble salt of cumene sulfonate.

8. A composition according to claim 6 comprising from about 0.7% to about 1.5% of smectite-type clay selected from the group consisting of sodium montmorillonite and potassium montmorillonite.

9. A composition according to claim 1 additionally comprising up to about 15% of a detergent builder selected from the group consisting of water-soluble, alkali metal, ammonium or substituted ammonium phosphates, polyphosphates, phosphonates, polyphosphonates, carbondates, silicates, borates, polyhydroxy sulfonates, polyacetates, carboxylates, and polycarboxylates.

10. A composition according to claim 1 additionally comprising from about 0.025% to about 2% of enzymes.

11. A composition according to claim 10 additionally comprising up to about 5% of ethanol.

12. A composition according to claim 1 which has a viscosity of from about 250 to about 450 centipoises.

13. A composition according to claim 12 which has a yield value of from about 30 to about 80 dynes/square centimeter.

14. A composition according to claim 13 which has a pH of from about 7.0 to about 8.5.

15. A composition according to claim 14 comprising from about 7% to about 14% of a nonionic surfactant produced by condensing an average of from about 5 to about 10 moles of ethylene oxide with 1 mole of a primary alcohol having a straight alkyl chain containing from about 10 to about 14 carbon atoms, said nonionic surfactant having an HLB of from about 9 to about 12, and 3% to about 10% of $C_{12-16}$ alkyl sulfate containing an average of from 0 to about 2.5 moles of ethylene oxide per mole of alkyl sulfate.

16. A composition according to claim 15 comprising from about 3% to about 10% of ion pair complex particles having an average dismeter of from about 20 to about 250 microns, said particles comprising: (1) from about 40% to about 90% by weight of said particles, of an ion pair complex having the formula:

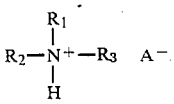

wherein $R_1$, $R_2$, $R_3$ and A are as stated in claim 1; and (2) from about 60% to about 10%, by weight of said particles, of an ion pair complex having the formula:

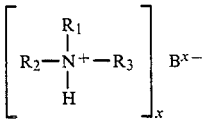

wherein $R_1$, $R_2$, $R_3$, B and x are as stated in claim 1.

17. A composition according to claim 16 comprising from about 1% to about 2% of a water-soluble salt of cumene sulfonate; and from 0.7% to to about 1.5% of smectite-type clay selected from the group consisting of sodium montmorillonite and potassium montmorillonite.

18. A composition according to claim 17 wherein the complex particles compise about 50% to about 80% of an ion pair complex of hydrogenated ditallow or distearyl amine and cumene sulfonate and from about 50% to about 20% of an ion pair complex of hydrogenated ditallow or distearyl amine and sulfate.

* * * * *